US005190009A

United States Patent [19]

Kadota

[11] Patent Number: 5,190,009

[45] Date of Patent: Mar. 2, 1993

[54] CONTROL DEVICE FOR AN ENGINE OF AN AUTOMOBILE

[75] Inventor: Yoichi Kadota, Himeji, Japan

[73] Assignee: Mitsubishi Denki Kabushiki Kaisha, Tokyo, Japan

[21] Appl. No.: 899,245

[22] Filed: Jun. 16, 1992

[30] Foreign Application Priority Data

Jul. 11, 1991 [JP] Japan ..... 3-170880

[51] Int. Cl.[5] ..... F02M 3/00

[52] U.S. Cl. ..... 123/339

[58] Field of Search ..... 123/339, 198 R; 322/14, 322/28, 29, 38; 290/40 C, 40 R, 40 B

[56] References Cited

U.S. PATENT DOCUMENTS 5,036,812 8/1991 Fukui et al. ..... 123/339
5,057,764 10/1991 Fujimoto et al. ..... 322/14
5,080,059 1/1992 Yoshida et al. ..... 123/198 R
5,140,960 8/1992 Fujimoto et al. ..... 123/339

*Primary Examiner*—Raymond A. Nelli
*Attorney, Agent, or Firm*—Sughrue, Mion, Zinn, Macpeak and Seas

[57] ABSTRACT

A control device for an engine of an automobile comprising:

a power supply switch which is switched to ON or OFF by a driver; and OR circuit which calculates a logical sum of an ON/OFF signal of the power supply switch and a signal corresponding to a pulse signal outputted from a central processing unit; a power supply relay which is activated to supply power to the control device for an engine of an automobile by the OR circuit when the power supply switch is switched to ON, and which is deactivated to cut power to the control device for an engine of an automobile when the power supply switch is switched to OFF and the signal corresponding to the pulse signal outputted from the central processing unit goes off; and a detecting means for detecting that outputting of the pulse signal is stopped when an initializing operation of an actuator by the central processing unit is finished and for outputting an output of the signal corresponding to the pulse signal to the OR circuit and to an actuator driving circuit for driving the actuator.

1 Claim, 5 Drawing Sheets

FIGURE 2A Power supply switch

FIGURE 2B (a) signal

FIGURE 2C (b) signal

FIGURE 2D Load driving signal (d)

FIGURE 2E Power supply

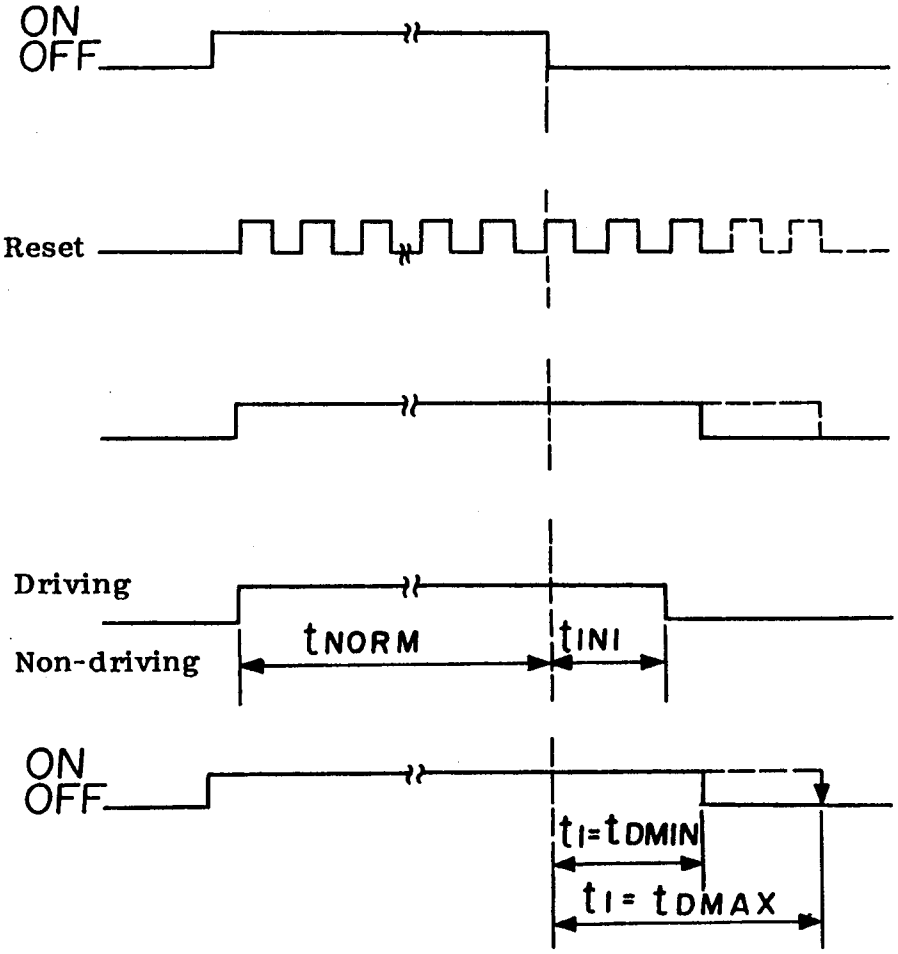
FIGURE 6A Power supply switch
FIGURE 6B (a) signal
FIGURE 6C (b) signal
FIGURE 6D Load driving signal (d)
FIGURE 6E Power supply

CONTROL DEVICE FOR AN ENGINE OF AN AUTOMOBILE

BACKGROUND OF THE INVENTION

1. Field of the Invention

This invention relates to a control device for an engine of an automobile for controlling the engine of an automobile wherein, when a power source relay for supplying power to the device per se, is switched to OFF, in compliance with an outside switch, a delay control is performed through a program for performing initializing operations of actuators.

2. Discussion of Backgroud

Among various functions of the control device for an engine of an automobile, there are initializing operations of actuators installed in various positions of an engine. Generally, this initializing operation is performed for the purpose of detecting a reference position of an actuator or checking the operation thereof. The operation is performed during non-operation of an engine instantly after power supply is ON, or instantly before power supply is OFF, so that it does not interfere with a normal control operation.

As an example of the initializing operation, a device is known wherein an idling revolution speed of an engine is controlled by controlling air quantity bypassing a throttle valve as shown in FIG. 3. This is called an ISC device, and the construction thereof is as shown in FIG. 3.

In FIG. 3, a reference numeral 11 designates an engine, 15, a throttle valve which moves cooperating with an accelerator and controls an intake quantity of air to the engine 11, 12, an idling switch showing that the throttle valve 15 is fully closed when a driver steps off the accelerator, and the engine 11 is in an idling state, and 16, a sensor for detecting an engine speed.

A numeral 14 designates an ISC device which receives signals from the idling switch 12 and the engine speed sensor 16, and controls an air quantity in a throttle valve bypass passage by operating an ISC (idling speed control) actuator 13, for controlling the engine speed to a predetermined value when the engine 11 is in the idling state.

As shown in FIG. 4, the air quantity passing through the bypass passage, is obtained by detecting an operational position of the ISC actuator 13 (position of an end portion 17 of the ISC actuator). In FIG. 4, the bold line shows a fully open position of an actuator, and the broken line, a fully closed position thereof.

On the other hand, the operational position of the ISC actuator 13 is detected as a relative position from the fully closed or the fully open position of the ISC actuator 13. Accordingly, it is necessary to always recognize the reference position (the fully closed position or the fully open position) of the ISC actuator 13. This is performed by operating the ISC actuator 13 until it reaches a maximum movable position (the fully closed position or the fully open position) as an initializing operation.

In this way, the ISC device 14 always detects the operational position of the ISC actuator 13, is capable of detecting the air quantity flowing in the bypass passage, and capable of controlling the ISC actuator 13 at a predetermined position (an ISC actuator position for flowing air in the bypass passage which corresponds to a required air quantity on the engine side) during off-idling operation, thereby enabling a smooth switching of the engine to the idling operation, thereafter.

When the initializing operation is performed instantly after the power is ON, in case that the engine is started up instantly after the power is ON, it may be necessary to start a principal control during the initializing operation.

Furthermore, when the initializing operation is performed instantly before the power is OFF, and when the initializing operation is performed at a timing when the power supply is switched to OFF, the actuator stops operating at that time point. Accordingly, since the detection of the actuator position can not be performed when the power supply is ON in the next operation, the control behavior thereafter may be malfunctioned.

Therefore, to prevent this, it becomes necessary to switch the power supply to OFF with certainty after the initializing operation is finished.

To realize this, a construction may be considered wherein the power supply source is controlled by the device per se which controls the actuator installed in the engine, based on an order signal of power supply of ON/OFF from the automobile driver, and is switched to OFF with certainty after the initializing operation is finished.

FIG. 5 shows construction of a conventional control device for an engine of an automobile. Explanation will be given to the operation of the conventional control device for an engine of an antomobile referring to FIG. 5. A reference numeral 1 designates a power supply switch, which is switched to ON/OFF by an antomobile driver. This ON/OFF signal is inputted to a power supply relay control circuit 35 in an engine control unit (hereinafter, ECU) 100 for an automobile, and a central processing unit (hereinafter, CPU) 32.

When the power supply relay control circuit 35 receives the ON signal, by outputting the ON signal to the base of a transistor Trl, the transistor Trl is switched to ON and an exciting current is flown in a coil 2*a* of a power supply relay 2 from a power source VB, a terminal 2*b* is closed, and power VB is supplied to a power supply circuit 31 in the ECU 100 through the terminal 2*b*.

When power is supplied to the ECU 100, the CPU 32 starts operating, and outputs a watchdog signal "a" to a watchdog detecting circuit 33. This watchdog detecting circuit outputs a reset signal "b" to the CPU 32, in case that the watchdog signal "a" is not inputted when an operational malfunction is generated in the CPU 32, or the like, restarts the CPU 32, outputs a load driving prohibiting signal to an actuator driving circuit 34, prohibits an output of a load driving signal "d" from the actuator driving circuit 34, and separates a load control from the CPU 32.

FIGS. 6A through 6E are timing charts for showing the operation of the conventional control device for an engine of an automobile. Simultaneously with when the power switch 1 is switched to ON, as shown in FIG. 6A, the power is switched to ON, as shown in FIG. 6E, the CPU 32 is operated, the watchdog signal "a" is outputted as shown in FIG. 6B, and a load driving allowing signal "c" is outputted from the watchdog detecting circuit 33 to the actuator driving circuit 34, the load driving signal "d" is outputted from the actuator driving circuit 34, as shown in FIG. 6D, and the driving of the actuator (load) is performed in the period of $t_{NORM}$ as shown in FIG. 6D.

Next, explanation will be given to the operation of the control device when the power is OFF, referring to FIGS. 5 and 6A through 6E. When the power switch 1 is switched to OFF by the driver of the automobile, as shown in FIG. 6A, the CPU 32 stops the normal control of the actuator (load), and starts the initializing operation. At the same time, the power supply relay control circuit 35, after receiving the OFF signal of the power switch 1, outputs the OFF signal to the transistor Trl after a predetermined time period of $t_1$, demagnetizes the coil 2a of the power supply relay 2, and switches the terminal 2b to OFF.

Furthermore, when the watchdog signal "a" is not inputted from the CPU 32 to the watchdog detecting circuit 33, the reset signal "b" is outputted from the watchdog detecting circuit 33 to the CPU 32 as shown in FIG. 6C.

Since the conventional control device for an engine of an automobile is constructed as above, the initializing operation of the actuator requires at least time for the actuator to move to the reference position. The initializing operation may require several seconds, depending on where the actuator position is instantly before the initializing operation. As shown in FIGS. 6A through 6E, the delay time for making the power supply OFF of $t_1$ is necessary to be longer than an initializing time $t_{INI}$. There are two problems in the conventional device to achieve this with certainty.

(1) To realize a timer of several seconds or more in a circuit ($t_{INI} \leqq t_{DMIN}$ is satisfied in FIG. 6E), a condenser having a considerably large capacity is necessitated, which enlarges the scale of the ECU 100.

(2) Since the initializing control of the actuator is performed by the CPU 32, the initializing time $t_{INI}$ can accurately be controlled. However, the delay time for POWER OFF, $t_1$ constructed by a circuit should be set to a large value having a considerable allowance with respect to a maximum value of $t_{INI}$, considering age deterioration or the like of electronic components which constitute the circuit. As a result, current may be flown during a period of more than necessary after the driver switches off the power supply.

SUMMARY OF THE INVENTION

It is an object of the present invention to solve the above problems. It is an object of the present invention to provide a control device for an engine of an automobile capable of dispensing with a power supply relay control circuit having a delay circuit of several seconds and a condenser having a large capacity, alloting the other functions to the dispensed portions in the ECU, thereby enhancing the function, shortening the delay time from power switch OFF to POWER OFF, whereby an unnecessary POWER ON period is eliminated and a battery power source of an automobile can effectively be utilized.

According to an aspect of the present invention, there is provided a control device for an engine of an automobile comprising:

a power supply switch which is switched to ON or OFF by a driver;

an OR circuit which calculates a logical sum of an ON/OFF signal of the power supply switch and a signal corresponding to a pulse signal outputted from a central processing unit;

a power supply relay which is activated to supply power to the control device for an engine of an automobile by the OR circuit when the power supply switch is switched to ON, and which is deactivated to cut power to the control device for an engine of an automobile when the power supply switch is switched to OFF and the signal corresponding to the pulse signal outputted from the central processing unit goes off; and a detecting means for detecting that outputting of the pulse signal is stopped when an initializing operation of an actuator by the central processing unit is finished and for outputting an output of the signal corresponding to the pulse signal to the OR circuit and to an actuator driving circuit for driving the actuator.

In this invention, in the sequential control when the power supply is OFF, even if the driver switches off the power supply switch, and the OFF signal is applied to the OR circuit, the CPU keeps outputting the pulse signals, and a signal corresponding with the pulse signal is applied to the OR circuit, which makes the power supply relay in an activated state, thereby supplying power to the CPU.

When the CPU performs the initializing operation of the actuator, and when the operation of the initializing finishes, the CPU stops outputting the pulse signals, and a signal corresponding with that is applied to the OR circuit, by which the power supply relay is deactivated, and the power supply to the CPU is cut, which operates to switch the power supply to OFF in a minimum time from when the driver switches off the power supply switch.

BRIEF DESCRIPTION OF THE DRAWINGS

FIGS. 6A through 6E are timing charts for explaining the operation of the conventional control device for an engine of an automobile.

DETAILED DESCRIPTION OF THE PREFERRED EMBODIMENTS

Explanation will be given to embodiments of a control device for an engine of an automobile according to the present invention based on the drawings as follows.

Figure 1:
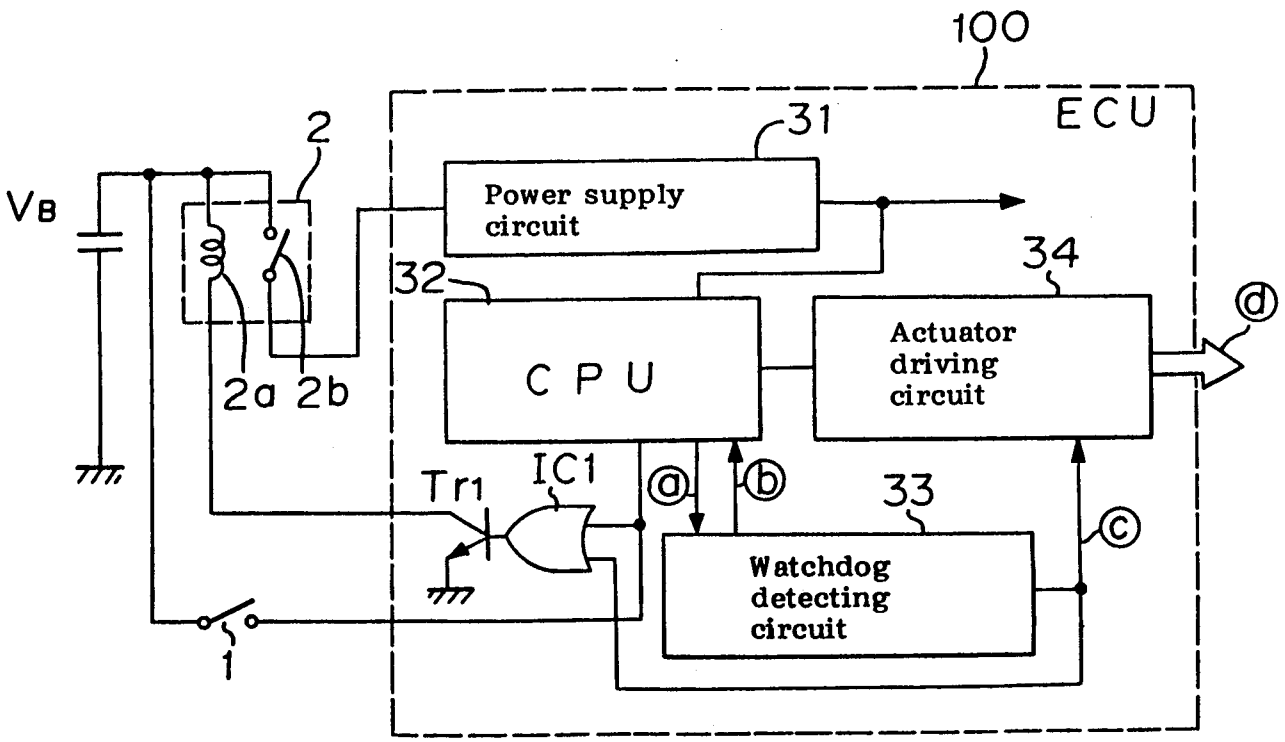
FIG. 1 is a block diagram of an embodiment of a control device for an engine of an antomobile according to the present invention.
Figure 5:
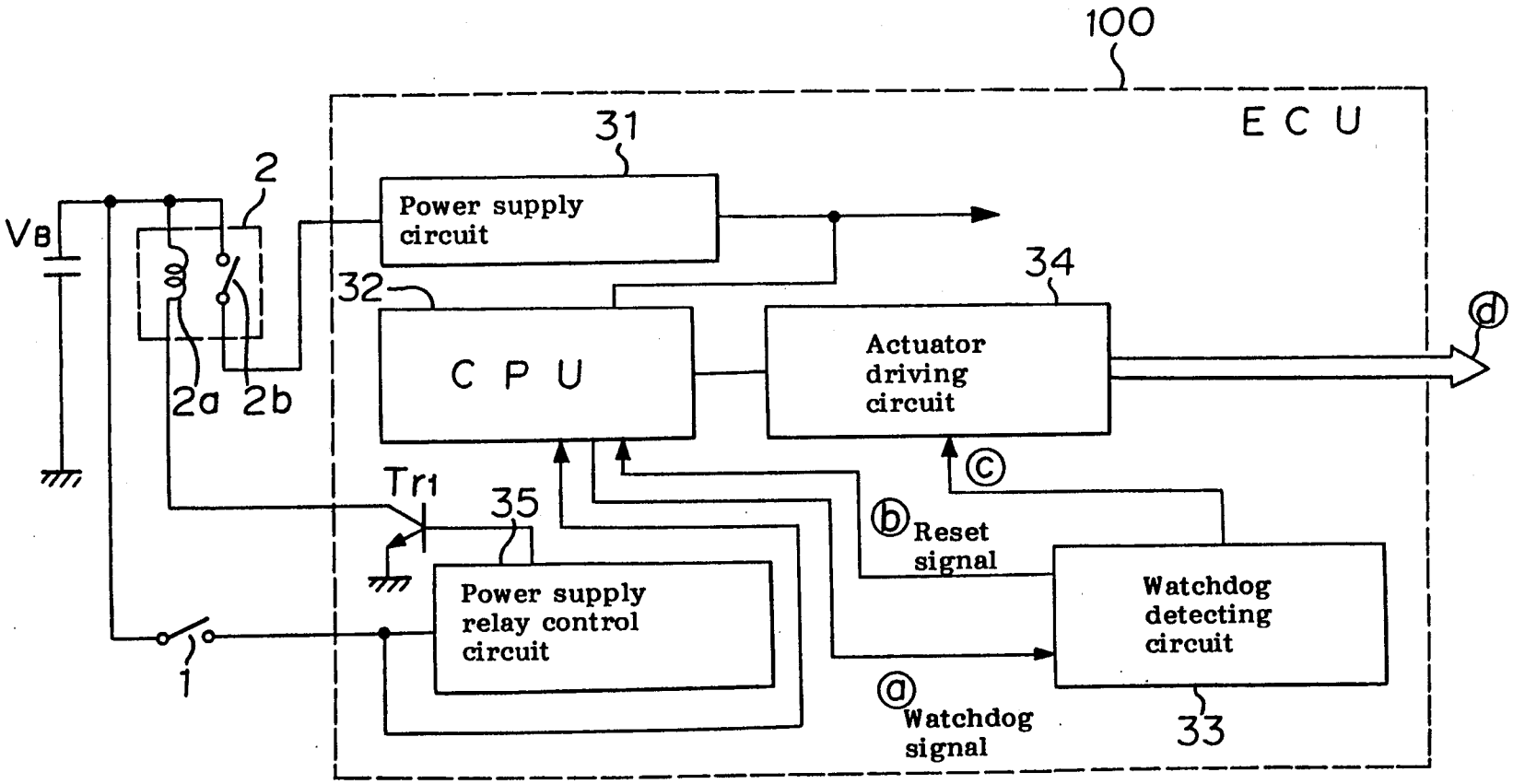
FIG. 5 is a block diagram showing a conventional control device for an engine of an automobile.

FIG. 1 is a block diagram showing a construction of an embodiment thereof. In FIG. 1, the same portion as that in FIG. 5 is attached with the same notation and the duplicated explanation is omitted. Explanation will be given to mainly portions different with those in FIG. 5.

As is apparent by comparing FIG. 1 with FIG. 5, in FIG. 1, the power supply relay control circuit 35 which controls the transistor Trl for controlling the power supply relay 2, is omitted. This invention differs with the conventional example in that the transistor Trl is controlled by an OR signal of the power supply switch 1 and an OR signal of the watchdog detecting circuit 33 as a pulse detecting means, instead of controlling by the power supply relay control circuit 35.

That is, when the power supply switch 1 is switched to ON, the ON signal is supplied to a first input terminal of an OR circuit ICl having two input terminals and the CPU 32, and the load driving allowing signal "c" outputted from the watchdog detecting circuit 33, is inputted to a second input terminal of the OR circuit ICl. The OR circuit ICl calculates a logical sum of these, and inputs it to the base of the transistor Trl. The other construction is the same as that in FIG. 5.

Next, explanation will be given to the operation also utilizing the timing charts of FIGS. 2A through 2E. First, explanation will be given to the operation when the power supply is ON. When the power supply switch 1 is switched to ON by a driver, as shown in FIG. 2A, the ON signal is inputted to the first input terminal of the OR cuicuit ICl and the CPU 32 in the EC 100.

The ON signal applied to the OR circuit ICl is inputted to the base of the transistor Trl from an output terminal of the OR circuit ICl, by which the transistor Trl is switched to ON, the coil 2a of the power supply relay 2 is excited, and the terminal 2b is closed.

Figure 2:
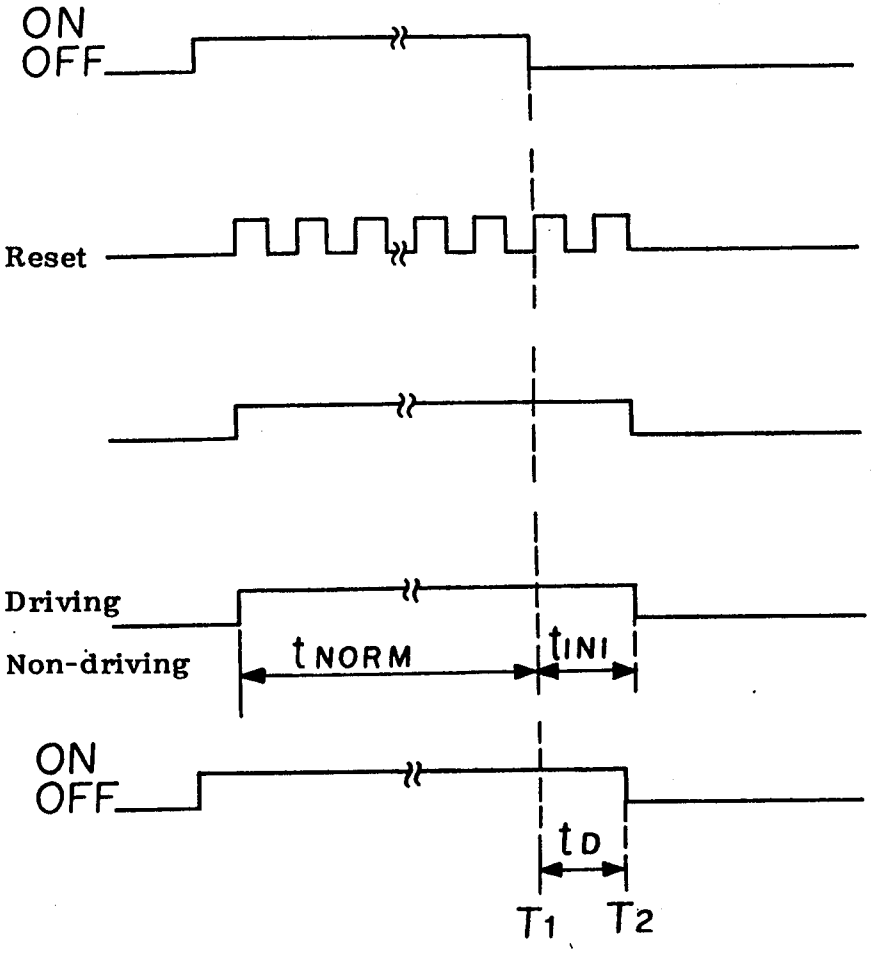
FIGS. 2A through 2E are timing charts for explaining the operation of the embodiment.
Figure 3:
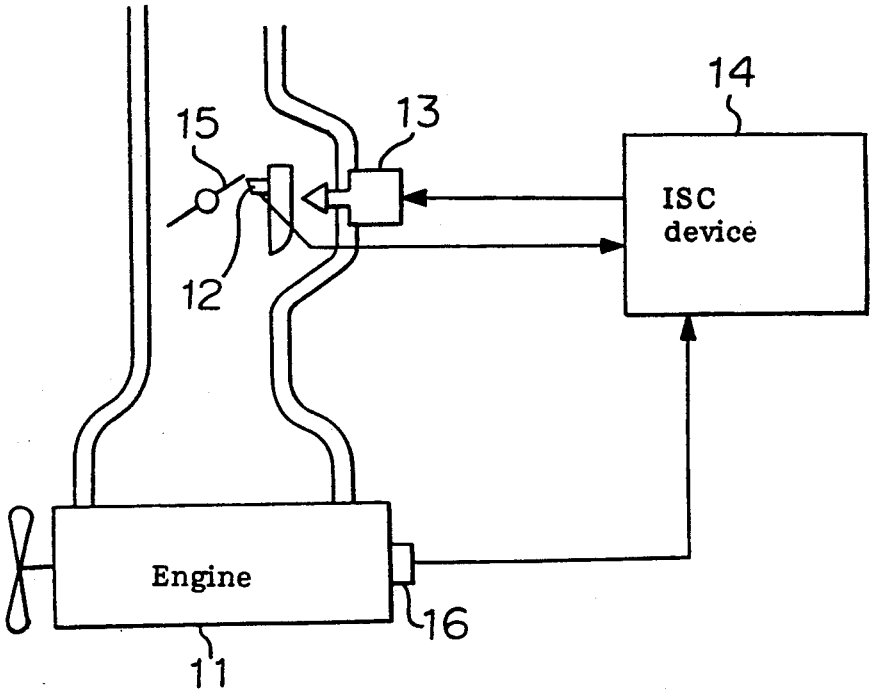
FIG. 3 is an explanatory construction diagram for a conventional ISC device.
Figure 4:
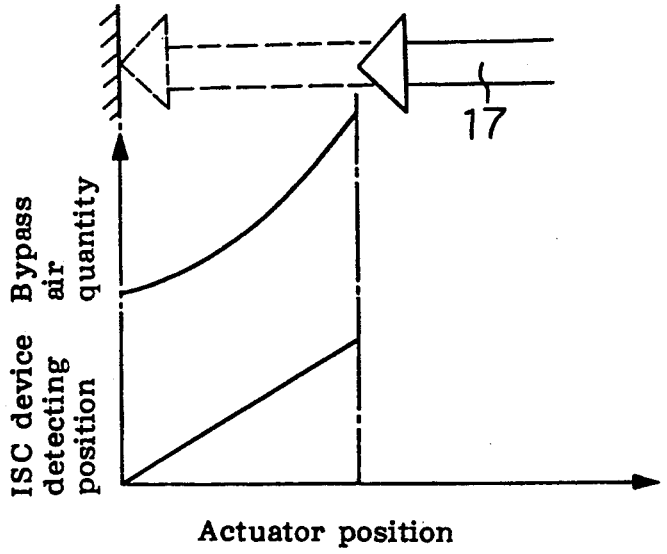
FIG. 4 is an explanatory operation diagram of an ISC actuator of the conventional ISC device.

By closing the terminal 2b, a voltage of the power supply source VB is supplied to the power supply circuit 31 in the CPU 100 through the terminal 2b, as shown in FIG. 2E, and the voltage of the power supply source VB is supplied to the CPU 32 from an output terminal of the power supply circuit 31.

Next, explanation will be given to the operation when the power is OFF. When the power supply switch 1 is switched to OFF by a driver as shown in FIG. 2A, the OFF signal is inputted to the OR circuit ICl and the CPU 32 in the ECU 100 as shown in FIG. 2E.

At this time point, since the CPU 32 keeps outputting the watchdog signal "a" as shown in FIG. 2B, and since the load driving allowing signal "c" from the watchdog detecting circuit 33 is in "ENABLE" state, the outputting of the OR circuit ICl is in "ENABLE" state, the power supply relay 2 stays ON since the transistor Trl stays in the ON state. Accordingly, as shown in FIG. 2E, the voltage of the power supply source VB is being applied to the ICU 100. This is the state of the time point $T_1$ in FIGS. 2A through 2E.

Next, the CPU 32 performs the initializing operation to the actuator. Thereafter, when the initializing operation is finished, the output of the watchdog signal "a" shown in FIG. 2B, is stopped.

The watchdog detecting circuit 33 detects the stoppage of the watchdog signal, outputs the reset signal "b" to the CPU 32 as shown in FIG. 2C, at the same time, releases (disable) the output of the load driving allowing signal "c" to the actuator driving circuit 34 and the OR circuit ICl, and performs to stop operating the actuator driving circuit 34 and the POWER OFF operation to the ECU 100. This is the state of the time point $T_2$ in FIGS. 2A through 2E.

As shown in FIG. 2E, since the above sequential control is continuously performed, the initializing operating time $T_{INI}$ after POWER OFF becomes the same with the delay time $t_D$ from when the power switch 1 is switched to OFF to when the power is switched to OFF, by which the delay time $t_D$ can be controlled to a minimum.

As stated above, according to the present invention, the supply state of the power source is maintained in the CPU by the power supply relay during the time wherein the CPU keeps outputting the pulse signals, when the power supply switch is switched to OFF by a driver. When the initializing operation of the actuator which is initialized by the CPU is finished and the stoppage of the outputting of the pulse signals is detected by the detecting means, the pulse supply relay is deactivated and the power supply to the CPU is cut. Accordingly, a power supply relay control circuit having a delay circuit of several seconds is dispensed with, and a condenser having a large capacity constituting the portion is dispensed with.

Accordingly, by introducing the other functions to the vacant space, it becomes possible to realize an ECU having higher function with the same ECU size.

Furthermore, the delay time $t_D$ from when the power supply switch is switched to OFF to when the power supply is switched to OFF, can be shorten to the initializing operating time $t_{INI}$ of the actuator after the power supply is switched to OFF. Accordingly, the period of unnecessary power supply ON found in the conventional device can be dispensed with, thereby effectively utilizing a battery power source of an automobile.

What is claimed is:

1. A control device for an engine of an automobile comprising:

a power supply switch which is switched to ON or OFF by a driver;

an OR circuit which calculates a logical sum of an ON/OFF signal of the power supply switch and a signal corresponding to a pulse signal outputted from a central processing unit;

a power supply relay which is activated to supply power to the control device for an engine of an automobile by the OR circuit when the power supply switch is switched to ON, and which is deactivated to cut power to the control device for an engine of an automobile when the power supply switch is switched to OFF and the signal corresponding to the pulse signal outputted from the central processing unit goes off; and a detecting means for detecting that outputting of the pulse signal is stopped when an initializing operation of an actuator by the central processing unit is finished and for outputting an output of the signal corresponding to the pulse signal to the OR circuit and to an actuator driving circuit for driving the actuator.

* * * * *